US005328564A

United States Patent [19]

Jiang et al.

[11] Patent Number: 5,328,564

[45] Date of Patent: Jul. 12, 1994

[54] MODIFIED DIGESTION OF PAPER PULP FOLLOWED BY OZONE BLEACHING

[75] Inventors: Jian E. Jiang; Brian F. Greenwood; Joseph R. Phillips, all of Glens Falls, N.Y.

[73] Assignee: Kamyr, Inc., Glens Falls, N.Y.

[21] Appl. No.: 836,585

[22] Filed: Feb. 18, 1992

Related U.S. Application Data

[63] Continuation-in-part of Ser. No. 583,043, Sep. 17, 1990.

[51] Int. Cl.[5] ..... D21C 3/02; D21C 9/153; D21C 9/16; D21C 11/00

[52] U.S. Cl. ..... 162/38; 162/65; 162/78; 162/82

[58] Field of Search ..... 162/19, 65, 82, 29, 162/78, 60, 30.11, 30.1, 38, 39, 40, 45

[56] References Cited

U.S. PATENT DOCUMENTS

| | | | |
|---|---|---|---|
| 3,294,623 | 12/1966 | Brinkley, Jr. et al. | 162/60 |
| 4,619,733 | 10/1986 | Kooi | 162/65 |
| 4,834,837 | 5/1989 | Loquenz et al. | 162/65 |
| 4,946,556 | 8/1990 | Prough | 162/60 |
| 5,164,043 | 11/1992 | Griggs et al. | 162/65 |

FOREIGN PATENT DOCUMENTS

WO91/18145 11/1991 PCT Int'l Appl. .

OTHER PUBLICATIONS

Liebergott et al, "Bleaching of Softwood Kraft Pulp Without Chlorine Compounds", *TAPPI J.*, Aug. 1984, pp. 76–80.

Macas et al, "Production of Bleached Chemical Pulp in the Future"; Int. Pulp Bleaching Conf. Jun. 13, 1991.

MCC TM literature, 1989.

*Primary Examiner*—Steve Alvo

*Attorney, Agent, or Firm*—Nixon & Vanderhye

[57] ABSTRACT

Kraft pulp is bleached to a brightness of about 90 CPPA or greater, without the use of chlorinated organic compounds that has commercially acceptable strength properties. During production of the kraft pulp it is subjected to extended delignification, by adding kraft white liquor to a first recirculation loop in the digester, and/or a second, wash, recirculation loop in the digester; or by conventional pulping followed by two oxygen stages, with washing between the stages. The extended delignification pulp is then subjected to ozone bleaching, with an ozone dosage of less than 1.0% (preferably less than about 0.5%). The ozone bleaching sequence may be a (ZE)P(ZE)P sequence.

12 Claims, 2 Drawing Sheets

MODIFIED DIGESTION OF PAPER PULP FOLLOWED BY OZONE BLEACHING

CROSS-REFERENCE TO RELATED APPLICATION

This application is a continuation in part of application Ser. No. 07/583,043 filed Sep. 17, 1990, the disclosure of which is hereby incorporated by reference herein.

BACKGROUND AND SUMMARY OF THE INVENTION

In the production of bleached kraft pulp there have been increasing regulatory and market demands to reduce or eliminate the presence of chlorinated organic compounds in pulp products and bleaching effluents. In order to properly react to such demands, it is necessary to eliminate the use of chlorine gas or any other chlorine containing compound. However the removal of the chlorine based bleaching agents makes it extremely difficult—in fact impossible under present technology—to achieve desired brightness levels, especially if the pulp produced is to have acceptable strength properties. For example oxygen delignification must be utilized, and multiple stage oxygen delignification—especially with chelating treatment to control deleterious metal ions—has been shown to offer advantages in delignification and selectivity, especially when there is between stage washing (see U.S. Pat. No. 4,946,556). However there are practical limits governing both the extent of delignification and the quality of pulp obtainable using oxygen delignification alone.

Of other available bleaching agents, perhaps the most promising is ozone. It has been demonstrated that ozone is a highly effective delignifying agent, however ozone has seen only marginal commercial acceptance to date in the pulp industry. The main obstacles to commercial utilization of ozone have been the chemical cost of ozone when large doses are needed, and the degradation of pulp strength that typically occurs relative to conventionally bleached pulps.

Thus, there has long been a need for bleached kraft pulp with commercially acceptable strength properties without the use of chlorine based bleaching agents. According to the present invention, it is possible to finally achieve that goal. This is accomplished according to the present invention by utilization of ozone in order to take advantage of its powerful delignifying effect, while limiting the amount of ozone applied to the pulp to less than 1%, and while holding pulp degradation to a minimum.

According to the present invention, the basic approach that is taken is to have a pulp with minimum Kappa Number and maximum strength before it is subjected to ozone bleaching sequence. This is accomplished according to the present invention by utilizing kraft pulp produced from extended delignification processes. Continuous digesters sold by Kamyr, Inc. of Glens Falls, N.Y. under the trademark "MCC" have, since 1988, been utilized to produce under a process known as modified continuous cooking a strong softwood kraft pulp with a Kappa Number of about 23 to 25 (this compares with the Kappa Number of about 30–32 achieved in conventional kraft ("CK") pulping of softwood). A variation of the modified continuous cooking process, practiced in digesters sold by Kamyr, Inc. of Glens Falls under the trademark "EMCC", practice a process known as extended modified continuous cooking. Such a process can produce softwood pulps having an even lower Kappa Number, typically 18–20, while maintaining a high pulp viscosity—comparable to that for a CK pulp at a Kappa Number of 30.

Another procedure that may be utilized to produce extended delignification pulp—allowing the production of high brightness, high strength bleached pulp without chlorine based bleaching agents—is to subject CK pulp to multiple stage oxygen delignification, with between stage washing, such as described in the above-mentioned U.S. Pat. No. 4,946,556. While the pulp produced according to this aspect of the invention has lower brightness and strength properties than pulp produced as set forth above, they are still within the commercially acceptable range.

The extended delignification pulp is, according to the invention, subjected to ozone bleaching, with an ozone dosage of less than 1.0% on pulp by weight (and preferably less than about 0.75% and most desirably less than about 0.5%), to produce a chlorine free bleached pulp with brightness of about 90 CPPA or greater. While a number of ozone bleaching sequences may be acceptable, one that is particularly advantageous is that described in co-pending application Ser. No. 07/721,780, filed Jun. 28, 1991. The bleaching sequence shown therein is (ZE)P(ZE)P, the (ZE) stages being ozone followed by extraction without washing between them. There is washing between the (ZE) and P stages. This bleaching sequence—especially if preceded by a pretreatment stage to remove metal ions, and two oxygen stages with between stage washing—produces excellent brightness (well over 90 CPPA) pulp, with good strength properties. Even though the pulp so produced has viscosity lower than CK pulp, it has been found that the lower viscosity does not mean less strength, and the T+2B value for pulp according to the invention is comparable to chlorine compound bleached VK pulp.

According to one aspect to the present invention, a method of continuously kraft pulping and then bleaching comminuted cellulosic fibrous material utilizing an upright digester having top, bottom, and central portions is provided. The method comprises the steps of: (a) Passing comminuted cellulosic fibrous material entrained in kraft white liquor into the top of the digester. (b) Extracting black liquor from at least one screen between the top and bottom of the digester. (c) At a first portion of the digester withdrawing and recirculating liquid in a first recirculation loop. (d) Adding kraft white liquor to the first recirculation loop. (e) Adjacent the bottom of the digester withdrawing and recirculating liquid in a second, wash, recirculation loop. (f) Withdrawing kraft pulp from the bottom of the digester, steps (a)-(e) being practiced to produce pulp having a Kappa Number comparable to about 25 or below for softwood. And, (g) ozone bleaching the kraft pulp with an ozone dosage of less than 0.1% on pulp by weight, to produce a chlorine-free bleached pulp with brightness of about 90 CPPA or greater. The procedure just described is Kamyr, Inc. 's modified continuous cooking process (hereafter "M"), typically practiced in an MCC TM digester. The method can include the further step of adding kraft white liquor to the second recirculation loop, in which case Kamyr, Inc. 's extended modified continuous cooking (hereafter "E") process is practiced, typically in a Kamyr EMCC TM digester.

According to another aspect of the present invention, a method of producing bleached kraft pulp is practiced comprising the following steps: (a) Subjecting kraft pulp to two stage oxygen delignification with between stage washing to produce pulp having a Kappa Number comparable to about 12 or less for softwood. And, (b) ozone bleaching the oxygen delignified kraft pulp with an ozone dosage of less than 1.0% on pulp by weight, to produce a chlorine-free bleached pulp with brightness of about 90 CPPA or greater.

It is the primary object of the present invention to provide for the production of kraft pulp having a brightness of greater than 90 CPPA and commercially acceptable strength, without utilizing chlorine containing bleaching compounds, and with minimal use of ozone. This and other objects of the invention will become clear from an inspection of the detailed description of the invention, and from the appended claims.

DETAILED DESCRIPTION OF THE DRAWINGS

Figure 1:
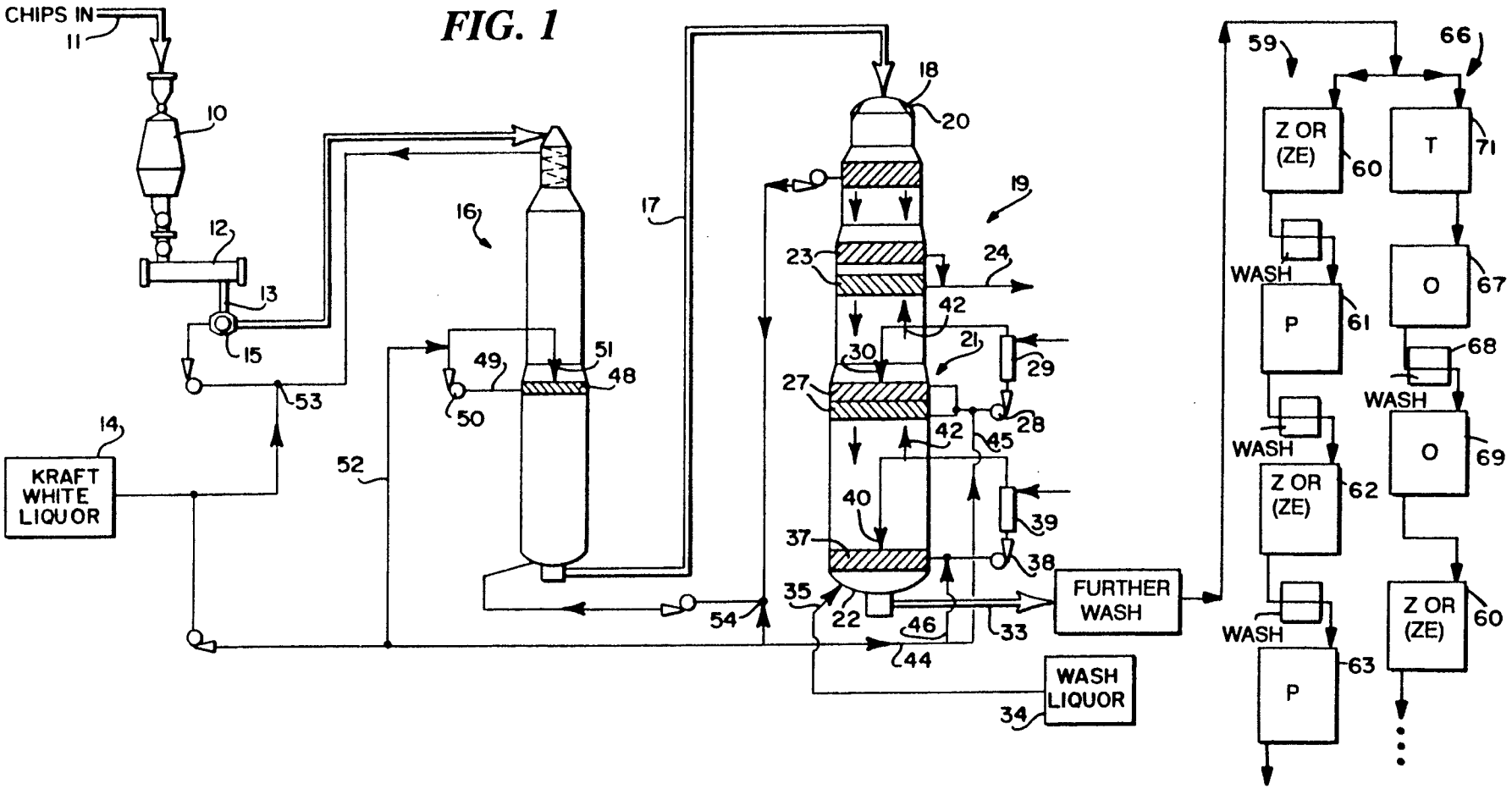
FIG. 1 is a schematic view showing apparatus for practicing the exemplary methods according to the invention in which modified continuous cooking, or extended modified continuous cooking, processes are employed to produce pulp, followed by ozone bleaching sequences.

An exemplary apparatus for kraft pulping according to the invention is illustrated in FIG. 1. Entirely standard components include a chips bin 10 for receiving a feed of chips 11 or like cellulosic comminuted fibrous material. From the chips bin 10, the material goes to a horizontal steaming vessel 12, and a vertical conduit 13, kraft white liquor from the source 14 being added to the material in the conduit 13 to slurry the material as it is fed to the high pressure feeder 15. From the high pressure feeder 15 the material entrained in kraft white liquor passes to an optional impregnation vessel 16, and then in line 17 to the top 18 of a continuous digester 19. At the top of the digester 19 there is a liquid/material separation device 20, which preferably comprises a plurality of bull screens with switching withdrawal from the screens, or the like. The digester 19 also includes a central portion 21 and a bottom 22.

At a portion of the digester 19 between the top 18 and the central portion 21 thereof one or more screens 23, and conduit 24, are provided as means for extracting black liquor from the digester 19. The black liquor is typically passed in conduit 24 to a series of flash tanks 25, as is conventional. At the central portion 21 of the digester 19, withdrawal screens 27 are also provided, being connected by a withdrawal conduit to a pump 28 and a heater 29 for re-introduction of the withdrawn liquid at point 30 of a re-introduction conduit, the point 30 typically being slightly above the screens 27. At the bottom 22 of the digester, kraft pulp is withdrawn in conduit 33 (a scraper or like conventional components can also be utilized), and wash liquor from source 34 is added in introduction conduit 35.

Adjacent the bottom of the digester 19 a wash screen (one or more rows) 37 is provided, liquid being withdrawn therethrough in a withdrawal conduit under the influence of pump 38, and then passing through heater 39 into a re-introduction conduit to be introduced at point 40 just above the screen 37. From the point 40 up to the screens 23, liquid flows countercurrently to the material—as designated by arrows 42—while above the screens 23 it flows concurrently.

What has been described so far, and including a main conduit 44 for adding kraft white liquor in conduit 45 to the first recirculation loop at digester central portion 21, is conventional in the Kamyr MCC TM system. According to the present invention, a conduit 46 is provided for interconnecting the main conduit 44 to the withdrawal conduit in the second, wash, recirculation loop provided by elements 37 through 40.

In the practice of the present invention, sufficient kraft white liquor is added in conduit 46 so as to achieve significantly enhanced viscosity and strength properties of the pulp produced compared to the practice of the same method without the introduction of kraft white liquor in conduit 46. For example, the amount of kraft white liquor added in conduit 46 is at least about 5% of the total amount of kraft liquor utilized to effect kraft pulping, and typically is about 10–20% (e.g. about 15%). Kraft white liquor preferably is also added—as is known per se—in conduit 45 in addition to conduit 46, the amount added in conduit 45 being at least about 10%, and preferably about 10–20%.

The apparatus of FIG. 1 also includes a recirculation loop at a central portion of the impregnation vessel 16, including screen 48, withdrawal conduit 49, pump 50, and re-introduction conduit/point 51. Kraft white liquor from source 14 also is preferably added as indicated by lines or points 52, 53, 54 to the recirculation loop in the impregnation vessel 16, and to the recirculation conduits from the digester to the impregnation vessel 16, and from the impregnation vessel 16 to the high pressure feeder 15. Normally the majority of the white liquor used in the conventional continuous kraft pulping process is added at the points or conduits 52–54.

The extended delignification pulp, either M, or E, in line 33 is then subjected to ozone bleaching, after an optional (but preferred) further wash stage 58. Utilizing the apparatus 59 illustrated in FIG. 1, the pulp will be subjected to a first ozone stage 60. Preferably, the stage 60 is a (ZE) stage, such as described in co-pending application Ser. No. 07/721,780. Also, preferably the first (ZE) stage 60 is followed by a peroxide (P) stage 61, a second (ZE) stage 62, and a second peroxide stage 63. Washing is typically provided between the stages, as illustrated in FIG. 1.

As an alternative to the bleaching sequence with the apparatus 59, the bleaching sequence with the apparatus 66 may be utilized. In this bleaching sequence, the pulp in line 33 is subjected to a first oxygen bleaching stage 67, and after a between stage wash 68 to a second oxygen stage 69. The oxygen stages are preferably preceded by a pretreatment stage (T) 71 in which the pulp is pretreated to remove deleterious metal ions (e.g. chelating pretreatement.) The stages 67, 68, 69, 71 are shown per se in U.S. Pat. No. 4,946,556. After the second oxygen stage 69 (although further oxygen stages may be utilized), an ozone or (ZE) stage 60 is utilized, and then—if desired—the rest of the equipment 59, as earlier described, may be employed. The pulp produced has a brightness of 90 CPPA or greater, as well as excellent strength properties, comparable to those of CK chlorine bleached pulp of equivalent brightness.

Figure 2:
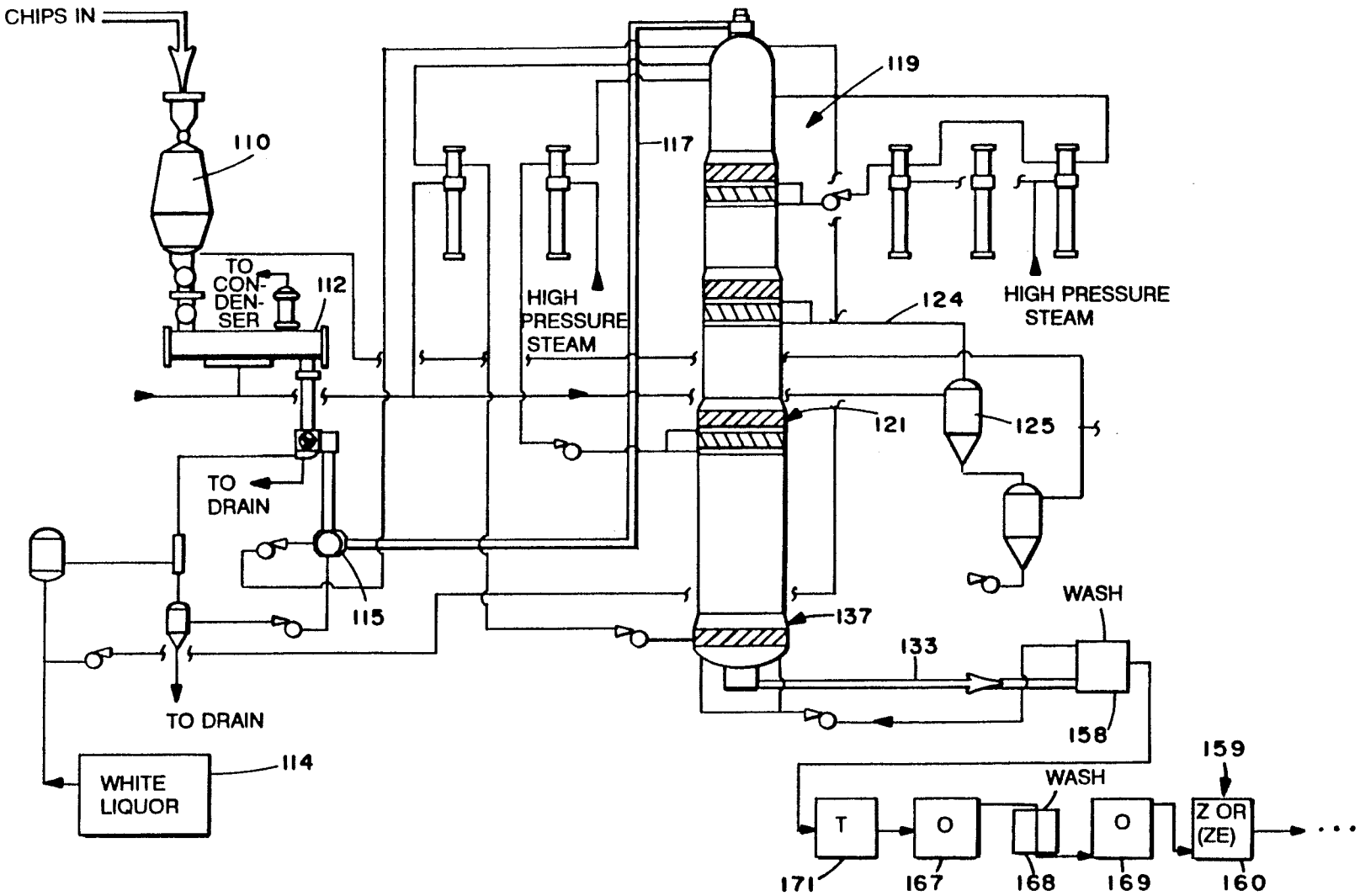
FIG. 2 is a view like that of FIG. 1 showing equipment for producing conventional kraft pulp which is then subjected to two stage oxygen delignification, and ozone bleaching, according to another aspect of the method of the present invention.

FIG. 2 illustrates another exemplary embodiment according to the invention. In FIG. 2 structures with the same function as those in FIG. 1 are shown by the same reference numeral only preceded by a "1". Since the structures have been previously described, most of them will not be described in detail. Suffice it to say that in FIG. 2 the continuous digester 119 provides a conventional kraft cook (CK), with the CK pulp being discharged from the digester in line 133. The CK pulp is then subjected to an optional wash at 158, then to pretreatment 171, two or more oxygen stages 167, 169 with between stage (168) washing, and then to ozone bleaching, utilizing a first (ZE) stage 160, and the other equipment 159, as described earlier with respect to equipment 59 in the FIG. 1 embodiment. The pulp produced utilizing the apparatus of FIG. 2—although not quite as bright (for a given amount of chemical) or strong as pulp produced utilizing the apparatus of FIG. 1—still has acceptable strength and a brightness of greater than 90 CPPA.

Utilizing the apparatus of FIG. 2, for example, a softwood conventional kraft pulp at Kappa 30 is delignified to Kappa 16.5 with the first $O_2$ stage 167 at 45% delignification. After the second stage 169, the Kappa Number is about 12 or less, e.g. about 10.5, with equal—if not superior—pulp viscosity and strength. This lower Kappa $O_2$-bleached pulp can then be further bleached with a small ozone dosage (about 0.5%) to maintain desired pulp strength, producing pulp with a brightness of greater than 90 CPPA. The combination of the two-stage oxygen with ozone bleaching thus results in about 65% less pollutants generated in the pulp bleaching operations than is conventional, and no chlorinated compounds.

The general processes according to the invention having been described, some data showing results obtained will now be set forth. The data which follows in tabular form was obtained by pulping and bleaching general techniques and conditions as follows:

Pulping

Hemlock chips from Western Canada (western hemlock 83%, 17% fir) were screened to remove over-sized chips, fines and pin chips. A 2-cubic-foot (57-liter) digester equipped with liquor circulation loops and indirect heating was used. A liquor-to-wood ratio of 4.0 was maintained in all cooks. White liquor sulfidity was about 35%.

At the beginning of each cook the chips were presteamed at 110° C. for five minutes. Addition of EA in the impregnation stage was carried out in a single step for the case of conventional (CK) cooks, but divided into two steps (initially and after five minutes) for the modified cooks (M & E). The counter-current stages were effected in the pilot cooks by simultaneously withdrawing a portion of the cooking liquor and adding fresh white liquor. The rate of liquor removal and addition was controlled in order to maintain the desired alkali and dissolved lignin profiles.

The cook was terminated by the addition of cold water, and the pulp was disintegrated by mechanical stirring of the diluted slurry. Knots were eliminated by passing the pulp through round hole screens (0.5"), and rejects were removed by screening through flat plates (0.012"). Screened pulps were dewatered by centrifuge.

Bleaching

The unbleached pulps were pin-shredded before use. Chlorination (D/C), chlorine dioxide (D), extraction (E), peroxide (P) and sodium borohydride (R) stages were performed in polyethylene bags. Exploratory trials were typically done using about 50 g (oven-dry basis) of pulp, while standard runs were carried out with 150 to 200 grams. Following initial mixing of the pulp with chemicals, the temperature of the sample was adjusted using a microwave oven and then held at temperature using a temperature-controlled water bath.

Oxygen delignification and oxidative extraction stages were carried out at medium consistency using heated autoclaves equipped with an internal shaft mixer. Caustic was first added to the pulp, the slurry was mixed and then the pulp was placed in the reactor. Both direct and indict steam heating were used to maintain reaction temperature. Stirring was gentle and continuous in order to maintain good oxygen to pulp contact.

In the O stages, the oxygen pressure was held constant for the entire retention time. For the Eo stages, the oxygen pressure was gradually reduced from the maximum pressure over the indicated oxygen retention time. In multi-stage oxygen delignification, washing was carried out between each stage.

Pretreatments (T), used to remove metal ions prior to oxygen stages, were carried out at 1% consistency, pH 7, with EDTA as the chelating agent. Addition of EDTA to an oxygen stage, where used, is indicated in the data tables.

Ozone (Z) stages were performed at 1% pulp consistency, using a modified blender apparatus. Normally, the pH of the pulp slurry was adjusted to 2.5 with dilute sulfuric acid prior t ozone treatment. Ozone-containing gas was bubbled into the stirred reaction vessel until the required charge of ozone had been absorbed by the pulp slurry. The pulp was held for the full retention time to allow complete reaction of ozone and oxidized products.

The pulping parameters and unbleached pulp properties for typical CK, M, and E processes are as follows:

TABLE I

| Cook | | CK | M | E |
|---|---|---|---|---|
| EA, | % NA2O | 14.4 | — | — |
| | Impregnation | — | 10.1 | 10.1 |
| | Co-Current | — | 3.1 | 3.9 |
| Max. Temp., °C. | | 171 | 160 | 162 |
| Time @ Temp, min | | 90 | — | — |
| | Co-Current | — | 60 | 60 |
| | Counter-Current | — | 240 | 240 |
| Total H Factor | | 1774 | 2067 | 2553 |
| Kappa no. | | 31.5 | 22.5 | 18.3 |
| Viscosity, cp | | 45.3 | 54.7 | 40.1 |
| V/K | | 1.44 | 2.43 | 2.19 |
| Total Yield, % | | 44.1 | 43.4 | 42.3 |
| Screened Yield, % | | 43.4 | 43.3 | 42.2 |

The brightness and strength properties of pulps produced according to the invention, compared to other production sequences, are set forth in Table II. The value "1" was obtained by—in a laboratory forum—taking E pulp (that is where white liquor is added to the second circulation loop, as illustrated by line 46 in FIG. 1, in addition to white liquor being added in line 45) and subjecting it to a complete sequence as illustrated schematically by the apparatus 66 in FIG. 1 (including the rest stages 61, 62, 63). The value "2" was produced in the same way as value "1" except that white liquor was not added in the second circulation loop (line 46), in the laboratory equivalent. Value "3" is pulp produced in the laboratory equivalent of the apparatus of FIG. 2. The other pulps are either conventional (e.g. pulp "5") or experimental pulps (e.g. "12"), or modifications of the preferred sequences according to the invention (e.g. "8" and "9").

TABLE II

| | | | 400 CSF | | | | | 9 KM | |
|---|---|---|---|---|---|---|---|---|---|
| Pulp | Sequence | Brightness | Viscosity cp | Tear Factor | Tensile km | Zero km | Span T + 2B | Tear Factor | T + 2B |
| 1. E | TOO(ZE)P(ZE)P | 91.0 | 12.2 | 132 | 9.8 | 14.5 | 294 | 153 | 307 |
| 2. M | TOO(ZE)P(ZE)P | 92.0 | 11.9 | 121 | 9.7 | 14.8 | 281 | 131 | 279 |
| 3. CK | TOO(ZE)P(ZE)P | 90.7 | 11.9 | 106 | 9.6 | 16.5 | 260 | 102 | 244 |
| 4. E | D/CEoDED | 89.7 | 27.7 | 152 | 10.3 | 17.1 | 334 | 187 | 328 |
| 5. CK | OD/CEoDED | 90.0 | 21.5 | 104 | 10.8 | 15.7 | 276 | 127 | 275 |
| 6. M | C/CEoDED | 91.1 | 28.8 | 144 | 10.8 | 14.3 | 312 | 217 | 359 |
| 7. M | OD/CEoDED | 90.1 | 21.3 | 138 | 10.1 | 12.8 | 298 | 170 | 308 |
| 8. M | TOOZRPZRP | 92.1 | 14.9 | 136 | 9.3 | 15.2 | 292 | 141 | 293 |
| 9. E | TOOZRPZRP | 90.2 | 14.6 | 135 | 9.7 | 15.1 | 295 | 156 | 300 |
| 10. E | OD/CEoDED | 89.2 | 19.3 | 141 | 9.7 | 16.1 | 309 | 158 | 316 |
| 11. CK | D/CEoDED | 89.8 | 32.1 | 108 | 11.5 | 17.0 | 298 | 146 | 306 |
| 12. E | TOO(ZE)PP | 85.1 | 9.5 | 110 | 9.6 | 12.5 | 264 | 119 | 259 |
| 13. E | OOZRD | 90.3 | 13.7 | 135 | 9.3 | 13.4 | 293 | 137 | 291 |
| 14. E | OO(ZE)D | 90.5 | 12.0 | 121 | 9.4 | 12.0 | 265 | 141 | 273 |

Table III provides further details of the treatment conditions for the pulps "1", "2" treatments set forth above in Table II.

TABLE III

| | | | | |
|---|---|---|---|---|
| Unbleached Pulp | 2(M) | | 1(E) | |
| Pretreatment, EDTA % | 0.5 | | 0.5 | |
| Kappa no. | 22.5 | | 18.3 | |
| Viscosity, cp | 54.7 | | 40.1 | |
| Bleaching Sequence | TOO(ZE)P(ZE)P | | TOO(ZE)P(ZE)P | |
| O: 12% Cs, 80 psig 02 | 01 | 02 | 01 | 02 |
| NaOH % | 1.2 | 1.5 | 1.2 | 1.5 |
| MgSO4, %/ EDTA, % | 0.5/0.2 | 0.5/0.2 | 0.5/0.2 | 0.5/0.2 |
| Temperature, °C. | 90 | 110 | 90 | 110 |
| Time, min | 30 | 60 | 30 | 60 |
| Kappa no. | 16.2 | 8.9 | 12.5 | 6.5 |
| Viscosity, cp | 37.4 | 25.2 | 30.7 | 21.0 |
| Z1: 1% Cs, 5° C., 30 min | | | | |
| Ozone, % | | 0.43 | | 0.23 |
| Kappa No. | | 4.4 | | 3.9 |
| Viscosity, cp | | 16.3 | | 17.9 |
| Brightness CPPA | | 63.7 | | 64.5 |
| El: 60 min, 65° C., 10% Cs or R1: 30 min, 40° C., 3.5% Cs | | | | |
| NaOH, % or NaBH4, % | | 1.8 | | 1.8 |
| Kappa number | | 2.7 | | 3.1 |
| Viscosity, cp | | 17.6 | | 17.7 |
| Brightness CPPA | | 65.3 | | 66.2 |
| P1: 10% Cs, 70° C., 3 h | | | | |
| H2O2, % | | 2.0 | | 2.0 |
| MgSO4, %/ Silicate, % | | 0.05/1.0 | | 0.05/1.0 |
| NaOH, % | | 0.2 | | 0.2 |
| Brightness CPPA | | 79.5 | | 77.7 |
| Viscosity, cp | | 15.7 | | 16.6 |
| Z2: 1% Cs,. 5° C., 30 min | | | | |
| Ozone, % | | 0.18 | | 0.19 |
| Kappa no. | | 0.8 | | 1.1 |
| Viscosity, cp | | 13.4 | | 12.7 |
| Brightness CPPA | | 87.5 | | 83.6 |
| E2: 60 min, 65° C., 10% Cs or R2: 30 min, 40° C., 3.5% Cs | | | | |
| NaOH, % or NaBH4, % | | 1.8 | | 1.8 |
| Kappa no. | | 0.6 | | 0.3 |
| Viscosity, cp | | 13.5 | | 13.5 |

TABLE III-continued

| | | |
|---|---|---|
| Brightness CPPA | 86.8 | — |
| P2: 10% Cs, 70° C. | | |
| H2O2, % | 1.0 | 1.0 |
| MgSO4, %/ Silicate, % | 0.05/1.0 | 0.05/1.0 |
| NaOH % | 0.15 | 0.10 |
| Time, h | 2 | 4 |
| Brightness CPPA | 92.0 | 91.0 |
| Viscosity, cp | 11.9 | 12.2 |

It will thus be seen that according to the present invention a high brightness, high strength bleached kraft pulp can be produced without chlorine based bleaching compounds. While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent processes and methods.

What is claimed is:

1. A method of continuously kraft pulping and then bleached comminuted cellulosic fibrous material using an upright digester having top, bottom, and central portions, consisting essentially of the steps of:

(a) passing comminuted cellulosic fibrous material entrained in kraft white liquor into the top of the digester;

(b) extracting black liquor from at least one screen between the top and bottom of the digester;

(c) at a first portion of the digester withdrawing and recirculating liquid in a first recirculation loop;

(d) adding kraft white liquor to said first recirculation loop;

(e) adjacent the bottom of the digester withdrawing and recirculating liquid in a second, wash, recirculation loop;

(f) withdrawing kraft pulp from the bottom of the digester, steps (a)-(e) being practiced to produce pulp having a Kappa Number of about 20 or below;

(g) adding kraft white liquor to the second recirculation loop, the liquor recirculated into the digester in part passing upwardly therein countercurrent to the material flow, the amount of white liquor added in the second recirculation loop being sufficient to increase the viscosity and strength properties of the pulp produced compared to the practice of the same method with the same material, Kappa Number, and other parameters only without step (g); and (h) without prior oxygen delignification ozone bleaching the kraft pulp from step (f) with an ozone dosage of less than 1.0% on pulp by weight, to produce a chlorine-free bleached pulp with brightness of about 90 CPPA or greater.

2. A method as recited in claim 1 wherein step (h) is practiced so that about 5–20% of the total amount of kraft white liquor utilized to effect kraft pulping is added during the practice of step (h).

3. A method as recited in claim 2 wherein step (h) is practiced by the bleaching sequence (ZE)P(ZE)P.

4. A method as recited in claim 2 wherein the kraft pulp has a Kappa Number prior to the practice of step (h) of about 12.

5. A method as recited in claim 1 wherein the kraft pulp has a Kappa Number prior to the practice of step (h) of about 12.

6. A method as recited in claim 1 further utilizing an impregnation vessel, and a conduit connected between the impregnation vessel and the digester; and wherein step (a) is practiced by adding kraft white liquor to the conduit and impregnation vessel, and so that the majority of the kraft white liquor added is added in the conduit and the impregnation vessel, about 5–20% of the kraft white liquor utilized to effect kraft cooking is added in step (h), and about 10–20% of the kraft white liquor utilized is added in step (d).

7. A method as recited in claim 6 wherein the kraft pulp has a Kappa Number prior to the practice of step (h) of about 12.

8. A method as recited in claim 1 wherein step (h) is practiced by the bleaching sequence (ZE)P(ZE)P.

9. A method as recited in claim 8 wherein the kraft pulp has a Kappa Number prior to the practice of step (h) of about 12.

10. A method as recited in claim 1 wherein step (h) is practiced with an ozone dosage of less than about 0.75% on pulp by weight.

11. A method as recited in claim 1 wherein step (h) is practiced with an ozone dosage of less than about 0.5% on pulp by weight.

12. A method as recited in claim 11 wherein the kraft pulp has a Kappa Number prior to the practice of step (h) of about 12.

* * * * *